United States Patent [19]

Schulz et al.

[11] Patent Number: 4,929,380

[45] Date of Patent: May 29, 1990

[54] PROCESS FOR THE PREPARATION OF A STORAGE-STABLE LIQUID DETERGENT COMPOSITION

[75] Inventors: Paul Schulz, Wuppertal; Karl Schwadtke, Leverkusen; Eduard Smulders, Hilden, all of Fed. Rep. of Germany

[73] Assignee: Henkel Kommanditgesellschaft aug Aktien, Duesseldorf, Fed. Rep. of Germany

[21] Appl. No.: 262,204

[22] Filed: Oct. 19, 1988

Related U.S. Application Data

[62] Division of Ser. No. 67,518, Jun. 26, 1987, abandoned.

[30] Foreign Application Priority Data

Jun. 27, 1986 [DE] Fed. Rep. of Germany ..... 3621536

[51] Int. Cl.[5] ..... C11D 11/00; C11D 1/83

[52] U.S. Cl. ..... 252/121; 252/95; 252/99; 252/108; 252/109; 252/550; 252/531; 252/539; 252/540; 252/559; 252/558; 252/DIG. 14

[58] Field of Search ..... 252/90, 135, 540, 108, 252/109, 132, 174.21, 174.25, DIG. 14, 95, 99

[56] References Cited

U.S. PATENT DOCUMENTS

| | | | |
|---|---|---|---|
| 3,169,930 | 2/1965 | Gedge | 252/135 |
| 3,368,977 | 2/1968 | Tuvell | 252/153 |
| 3,850,831 | 11/1974 | Hellsten et al. | 252/99 |
| 3,892,905 | 7/1975 | Albert | 206/0.5 |
| 4,064,062 | 12/1977 | Yurko | 252/99 |
| 4,264,466 | 4/1981 | Carleton et al. | 252/99 |
| 4,316,812 | 2/1982 | Hancock et al. | 252/99 |
| 4,326,979 | 4/1982 | Bus et al. | 252/174.24 |
| 4,436,644 | 3/1984 | Johnson et al. | 252/174.13 |
| 4,610,799 | 9/1986 | Wilsberg et al. | 252/90 |
| 4,743,394 | 5/1988 | Kaufmann et al. | 252/90 |
| 4,772,425 | 9/1988 | Chirash et al. | 252/547 |
| 4,797,231 | 1/1989 | Schumann et al. | 252/547 |

FOREIGN PATENT DOCUMENTS

| | | |
|---|---|---|
| 338947 | 1/1977 | Austria . |
| 1853 | 5/1979 | European Pat. Off. . |
| 158464 | 10/1985 | European Pat. Off. . |
| 168373 | 1/1986 | European Pat. Off. . |
| 2527388 | 4/1976 | Fed. Rep. of Germany . |
| 2539071 | 4/1976 | Fed. Rep. of Germany . |
| 2544035 | 4/1976 | Fed. Rep. of Germany . |
| 2559631 | 5/1977 | Fed. Rep. of Germany . |
| 1243784 | 8/1971 | United Kingdom . |
| 1429143 | 3/1976 | United Kingdom . |
| 1470250 | 4/1976 | United Kingdom . |
| 1504211 | 3/1978 | United Kingdom . |
| 1529454 | 10/1978 | United Kingdom . |

*Primary Examiner*—Prince E. Willis

*Attorney, Agent, or Firm*—Ernest G. Szoke; Wayne C. Jaeschke; Henry E. Millson, Jr.

[57] ABSTRACT

The invention provides a substantially anhydrous gas-free liquid detergent based on non-ionic surfactants containing a liquid surfactant component comprising adducts of from 2 to 8 moles ethylene oxide with 1 mole $C_{10-20}$- fatty alcohol, anionic surfactant, and low molecular weight polyethylene glycol. The liquid surfactant component makes up at least 20% by weight of the detergent as a whole; the ratio of fatty alcohol ethoxylate to anionic surfactant is from 1:1 to 2:1; and the detergent has a density of from 1.4 to 1.8. Typically, the detergent includes a particulate solids component which is incorporated with the liquid components as separate component fractions of differing particle size.

17 Claims, No Drawings

PROCESS FOR THE PREPARATION OF A STORAGE-STABLE LIQUID DETERGENT COMPOSITION

This application is a division, of application Ser. No. 067,518, filed 06/26/87, now abandoned.

BACKGROUND OF THE INVENTION

1. Field of the Invention

The primary function of non-ionic surfactants in detergents is to enable oily and fatty soil to be more effectively washed out. Since non-ionic surfactants are generally liquid, the quantity which can be incorporated in free-flowing detergents is limited by the capacity of the solid constituents of the detergent to take up these liquid constituents. In most cases, the fluidity of these detergents is adversely affected by the incorporation of an optimal quantity of non-ionic liquid surfactants, and thus, undesirably low quantities of these detergents are usually employed. In addition, non-ionic surfactants are difficult to process by hot-spraying methods currently widely used in the manufacture of detergents. In contrast, detergents having a high content of non-ionic surfactants are readily produced as liquid or paste-form detergents (referred to in the present specification as liquid detergents), and accordingly, the detergency of these materials on oily and fatty substrates is generally better than the detergency of free-flowing materials.

2. Discussion of Related Art

Detergents normally contain builders which promote detergency in various ways during the washing process. Builders are normally in the form of powders or granulates which, in liquid systems, have a tendency to sediment during prolonged storage. To obviate this disadvantage, the solids are typically completely ground to very small particle sizes (below 10 microns), as described for example, in U.S. Pat. No. 4,316,812. It is also known from U.S. Pat. No. 4,264,466 that certain clays inhibit the sedimentation of solids in these systems. EP 158,464 describes liquid detergents wherein the solids have a particle size of greater than 10 microns and wherein the non-ionic surfactants have a pour point of less than about 24° C. Unfortunately, known liquid detergents of this type generally must contain constituents that are inert with respect to detergency (ballast components) or that are unstable with respect to viscosity in storage; both these factors usually adversely affect dissolving rate under washing conditions. In addition, the long-term sedimentation stability of most of these products is unsatisfactory. Another disadvantage of known liquid detergents is the inadequate storage stability of commonly-used, chemically sensitive components, such as perborates, bleach activators and enzymes. Pronounced degradation of these components results in a significant loss of detergency and is responsible for the "gassing" of many liquid detergents on storage in hermetically sealed containers, such as typical portion packs.

DESCRIPTION OF THE INVENTION

Other than in the operating examples, or where otherwise indicated, all numbers expressing quantities of ingredients or reaction conditions used herein are to be understood as modified in all instances by the term "about".

Accordingly, the invention provides a liquid detergent based on non-ionic surfactants and builders which is characterized by good detergency ad good storage stability.

The detergent includes a liquid surfactant component comprising (a) an adduct of from 2 to 8 moles ethylene oxide with 1 mole $C_{10}$–$C_{20}$-fatty alcohol, (b) at least one anionic surfactant comprising a sulfate, sulfonate, or soap; and (c) polyethylene glycol having a molecular weight of from about 200 to 600;

with the proviso that the quantity of constituents (a)+(b)+(c) is at least 20% by weight, and more especially, from 20% to 50% by weight, of the detergent as a whole; that the ratio of (a) to (b) is from 1:1 to 2:1; that the detergent as a density of from 1.4 to 1.8; and that the detergent is substantially anhydrous and gas-free.

The expression "substantially anhydrous" means that the detergent contains at most 5% by weight unbound water; in addition, the detergent may also contain bound water, e.g., water in the form of water of crystallization of inorganic salts; or water which is adsorptively bound and which can only be removed by fairly intense heating, for example to above 400° C.; or water which is a raw material in the preparation of the detergent according to the invention. The expression "substantially gas-free" means that the detergent contains at most 5% by volume and preferably less than 3% by volume of constituents which are gaseous at room temperature. Substantially gas-free, liquid detergents according to the invention have substantially stable viscosity behavior, even over prolonged storage, and permit the desired viscosity to be adjusted more easily than can be done with detergents having a relatively high gas content. They have a high uniform density and represent the most compact form of presentation for the formulation in question. The low gas content permits the production of stable, free-flowing, pumpable detergents. The rate at which the detergents dissolve in the wash liquor is also improved in this way.

The carbon chain of the fatty alcohol of component (a) is linear or branched, saturated or unsaturated, and contains an odd or even number of carbon atoms. Apart from fatty alcohols derived from naturally occurring fatty acids, especially suitable alcohols are branched alcohols, particularly oxoalcohols.

Suitable anionic surfactants of the sulfate and sulfonate type broadly include those known in the art, especially alkylbenzene sulfonates containing $C_{9-15}$-alkyl groups; olefin sulfonates, i.e., mixtures of alkene and hydroxyalkane sulfonates; and also disulfonates of the type obtained, for example, from $C_{12-18}$-mono-olefins containing an internal or terminal double bond by sulfonation with gaseous sulfur trioxide and subsequent alkaline or acidic hydrolysis of the sulfonation products. Other suitable anionic surfactants are dialkane sulfonates of the type obtainable from $C_{12-18}$-alkanes by sulfochlorination or sulfoxidation and subsequent hydrolysis or neutralization, or by addition of bisulfites onto olefins; and also esters of $\alpha$-sulfofatty acid, for example, the $\alpha$-sulfonated methyl or ethyl esters of dihydrogenated coconut oil, palm kernel oil or tallow fatty acids. Suitable surfactants of the sulfate type include sulfuric acid monoesters of primary alcohols of natural or synthetic origin, e.g., of fatty alcohols, such as coconut oil fatty alcohols, tallow fatty alcohols, oleyl alcohol, lauryl alcohol, myristyl alcohol, palmityl alcohol, or stearyl alcohol, or $C_{10-20}$ oxoalcohols and secondary alcohols having the same carbon chain length.

Sulfuric acid monoesters of aliphatic primary or secondary alcohols ethoxylated with from 1 to 6 moles ethylene oxide are also suitable. Sulfated fatty acid alkanolamides and sulfated fatty acid monoglycerides are also suitable.

Soaps suitable for the purposes of the invention comprise soaps of the type known in the art, especially the alkali metal salts of saturated or unsaturated $C_{10-24}$-fatty acids. Soaps containing a relatively large number of carbon atoms, more especially from 14 to 24 carbon atoms, are typically used for foam inhibition. Soaps of saturated $C_{20-24}$-fatty acids are particularly suitable as foam inhibitors for detergents based on sodium triphosphate as builder, whereas detergents predominantly containing zeolite builders are usually more effectively foam-inhibited by soaps containing only from 14 to 18 carbon atoms, particularly at low washing temperatures.

Detergents having particularly favorable properties with regard to their cleaning power, their foaming behavior, and their solubility in water contain a sulfonate together with a soap as component (b). Preferably, the soap is a fatty acid alkali salt with foam-inhibiting properties, i.e., an alkali salt of fatty acids containing from 18 to 24 carbon atoms. Detergents which are particularly valuable with regard to their detergent action and their viscosity behavior contain as component (a) a non-ionic surfactant in the form of an adduct of from 3 to 5 moles ethylene oxide and 1 mole fatty alcohol. Adducts of ethylene oxide with $C_{12-18}$-fatty alcohols and, in particular, mixture of adducts of ethylene oxide with fatty alcohols having different chain lengths provide detergents with particularly valuable properties.

Compounds of particular interest as component (c) with respect to obtaining good viscosity behavior and dissolving rate of the detergents according to the invention are polyethylene glycols having a molecular weight of from about 300 to 400, i.e., compounds containing from about 7 to about 9 ethoxy units in the molecule. These hydrotropic liquid-phase additives typically contain terminal hydroxyl groups, or blocking terminal groups, for example methyl groups.

The ratio of components (a), (b) and (c) to one another is particularly important in formulating the detergents according to the invention. According to the invention, preferred detergents are those which contain component (a) in a ratio to component (b) of from 1.1:1 to 1.5:1, and component (c) in a quantity of from 2 to 10% by weight, based on the total weight of the detergent. Particularly effective detergents according to the invention contain components (a), (b) and (c) in a quantity of from 25 to 40% by weight.

Another feature of detergents according to the invention which provides particularly valuable properties is the presence of two types of particulate constituents, namely a first finely divided component having an average particle size ranging from the fineness of dust to 30 microns and a second coarser component having an average particle size in the range of from 200 to 2000 microns. The components may be the same or different with respect to characteristics other than particle size. "Dust-fine" particles are particles larger than 0.01 micron and more especially larger than 0.1 micron in size. Especially desirable are particles ranging from 200 to 2000 microns in size which are granulates comprising detergent constituents added to the liquid detergents in this form for handling reasons, or more often to prevent interaction with other detergent constituents.

Useful particulate detergent constituents are well known in the art and include, for example, builders. Particulate builders are organic and inorganic substances, preferably alkaline-reacting salts, more especially alkali salts, which are not only capable of precipitating or complexing calcium ions, but also produce a synergistic increase in detergency with the surfactants and show soil-suspending power. Among the inorganic salts, water-soluble alkali metaphosphates or alkali polyphosphates, particularly pentasodium triphosphates, are still of particular significance. In addition to these phosphates, organic complexing agents for calcium ions and heavy metal ions may also be present. These include aminopolycarboxylic acids, such as nitrilotriacetic acid, ethylenediamine tetra-acetic acid, diethylenetriamine penta-acetic acid and higher homologs. Suitable phosphorus-containing organic complexing agents are the water-soluble salts of alkane polyphosphonic acids, amin and hydroxyalkane polyphosphonic acids, and phosphonopolycarboxylic acids, for example, methane diphosphonic acid, dimethylaminomethane-1,1-diphosophonic acid, aminotrimethylene triphosphonic acid, ethylenediamine tetramethylene tetraphosphonic acid, diethylenetriaminepentamethylenepentaphosphonic acid, 1-hydroxyethane-1,1-diphosphonic acid, and 2-phosphonobutane-1,2,4-tricarboxylic acid.

Among the organic builders, N- and P-free polycarboxylic acids of the type which form complex salts with calcium ions, including polymers containing carboxyl groups, are of particular importance. Low molecular weight compounds, such as citric acid, 2,2'-oxydisuccinic acid, or carboxymethyloxysuccinic acid are suitable. Suitable polymeric polycarboxylic acids broadly have a molecular weight of from 350 to about 1,500,000 in the form of a water-soluble salt. Particularly preferred polymeric polycarboxylates have a molecular weight in the range of from 500 to 175,000, and more especially in the range of from 10,000 to 100,000. Polymeric polycarboxylates such as these include such compounds as polyacrylic acid, poly-$\alpha$-hydroxyacrylic acid, polymaleic acid and also copolymers of corresponding monomeric carboxylic acids with one another or with ethylenically unsaturated compounds, such as vinylmethylether. The water-soluble salts of polyglyoxylic acid are also suitable.

Suitable water-insoluble inoragnic builders are finely divided, synthetic sodium aluminosiliactes containing bound water of a zeolite-A type described in detail in German patent application 2,412,837 as phosphate substitutes for detergents and cleaning preparations. The cation-exchanging sodium aluminosilicates are used in their normal hydrated, finely crystalline form, i.e., containing substantially no particles larger than 30 microns in size and preferably comprising a particle fraction wherein at least 80% of the particles are smaller than 10 microns in size. Broadly, the zeolites have a calcium-binding power, as determined in accordance with the guidelines set forth in German patent 2,412,837, of from 100 to 200 mg CaO/g. Zeolite NaA is particularly suitable, although zeolite NaX and mixtures of zeolites NaA and NaX are also useful.

Suitable inorganic, non-complexing salts are the bicarbonates, carbonates, borates, sulfates or silicates of the alkalis, also known as "washing alkalis"; among the alkali silicates, the sodium silicates with a ratio of $Na_2O$ to $SiO_2$ of from 1:1 to 1:3,5 are particularly suitable.

Other builders, which are generally used in liquid formulations by virtue of their hydrotropic properties, are salts of non-capillary-active $C_{2-9}$-sulfonic acids, carboxylic acids and sulfocarboxylic acids, for example the alkali salts of alkane, benzene, toluene, xylene or cumene sulfonic acids, sulfobenzoic acids, sulfophthalic acid, sulfoacetic acid, sulfosuccinic acid, acetic acid, or lactic acid. Acetamide and urea are also suitable solution promoters.

Other useful particulate, especially granulate, detergent constituents useful in the practice of the invention include redeposition inhibitors, optical brighteners, enzymes, bleaches, bleach activators, and foam inhibitors.

Suitable redeposition inhibitors are cellulose ethers, such as carboxymethyl cellulose, methyl cellulose, hydroxyalkyl celluloses, and mixed ethers, such as methyl hydroxyethyl cellulose, methyl hydroxypropyl cellulose and methyl carboxymethyl cellulose. Mixtures of various cellulose ethers, particularly mixtures of carboxymethyl cellulose and methyl cellulose, are also suitable redeposition inhibitors. Suitable enzymes are enzymes customarily employed in conjunction with detergents, such as those from the protease, lipase and amylase classes and mixtures thereof. Enzymatic agents obtained from bacterial strains or fungi, such as *Bacillus subtilis, Bacillus licheniformis* and *Streptomyces griseus*, are particularly suitable. To protect against premature decomposition, the enzymes are generally encapsulated.

Suitable bleaching components are the various materials typically used in detergents and bleaches, especially perhydrates and other percompounds. Preferred perhydrates are sodium perborate which is used in the form of the monhydrate, or more especially, in the form of the tetrahydrate. Perhydrates of sodium carbonate (sodium percarbonates), sodium pyrophosphates (perpyrophosphates), sodium silicates (persilicate) and urea are also suitable. These perhydrates are generally used together with bleach activators. Sodium perborate tetrahydrate and sodium perborate monohydrate in conjunction with bleach activators are preferably used as the bleaching component. Suitable bleach activators are, in particular, N-acyl compounds and O-acyl compounds. Examples of suitable N-acyl compounds are polyacylated alkylene diamines, such as tetra-acetyl methylenediamine, tetra-acetyl ethylenediamine and higher homologs thereof, and also acylated glycol urils, such as tetra-acetyl glycol uril. Further examples are Na cyanamide, N-alkyl-N-sulfonylcarbonamides, N-acyl hydantoins, N-acylated cyclic hydrazides, triazoles, urazoles, diketopiperazines, sulfurylamides, cyanurates and imidazolines. In addition to carboxylic acid anhydrides, such as phthalic acid anhydride, and esters, such as Na (iso)nonanoyl phenol sulfonates, particularly suitable O-acyl compounds are acylated sugars, such as glucose penta-acetate. Preferred bleach activators are tetra-acetyl ethylenediamine and glucose penta-acetate. The bleach activators are also usually encapsulated to avoid interactions with percompounds or other substances such as enzymes. Detergent constituents such as these used in the form of granulates or in encapsulated form lead to products having particularly valuable properties. Detergents characterized by particularly high viscosity stability and sedimentation stability are obtained through the particular composition of the detergents and through the presence of particulate constituents in two different particle size ranges. Detergents according to the invention having a viscosity of from 10,000 to 1,000,000 mPas, as measured with a Brookfield RVT viscosimeter, spindle 6, at 1–10 r.p.m./20° C., are particularly preferred detergents.

The present invention also relates to a process for the production of a liquid detergent having the composition and properties described above. In this process, the liquid constituents of the detergent and those particulate constituents which do not interact chemically with one another or with the liquid constituents, even after size reduction, are thoroughly mixed in a first mixing step and the suspension obtained is subjected to wet grinding so that the average particle diameter of the solid constituents in the suspension obtained after grinding is at most 30 microns. The suspension is then degassed under vacuum in a known manner. In a second process step, the remaining particulate constituents, preferably a particle size of from 200 to 2000 microns, are degassed in vacuo without any size reduction, and the solids mixture thus degassed is mixed with the ground suspension from the first mixing step in a second mixing step with further degassing. Other auxiliaries, such as perfumes, dyes or hydrotropic compounds or other compounds for adjusting the desired viscosity are then added in vacuo to the resulting mixture. The degassing of the liquid and solid constituents ensures that the liquid detergents of the invention are substantially gas-free, which is reflected in a particularly stable viscosity behavior of the detergents. It appears that through this procedure, the suspension containing finely ground solids obtained after wet-grinding penetrates into the pores of the coarse solids as a whole, which thus establishes the viscosity stability of the product liquid detergent. Accordingly, the mean particle diameter of the solids in a finely ground suspension should be approximately of the same order as, or below, the mean pore size of the coarsely particulate, solid detergent ingredients incorporated without any reduction in particle size.

A particular advantage in terms of handling is obtained by packing the detergents in portions in bags of a water-soluble film. A particularly preferred form of presentation for the detergents is one in which they are packed in bags of film based on polyvinyl alcohol. In terms of handling in domestic washing machines, it is of particular advantage if the bags contain enough of the detergent according to the invention to wash one washing machine load. Suitable films are, for example, polyvinyl alcohol films having a film thickness of 65 microns which are formed by heat sealing or wet sealing into sealed bags containing the detergent.

EXAMPLES

Example 1

25.2 kg $C_{12-18}$ fatty alcohol+5 moles ethylene oxide, 100.8 kg $C_{12-14}$-fatty alcohol+3 moles ethylene oxide, 120.0 kg alkylbenzene sulfonate powder, 75.0 kg polyethylene glycol (molecular weight 400), 326.5 kg sodium tripolyphosphate, 50.0 kg powdered soda waterglass having an $SiO_2$:$Na_2O$ ratio of 2.0 and a residual water content of approximately 20% by weight, and 5.0 kg of 3:7-mixture of methyl cellulose and carboxymethyl cellulose were mixed together in a stirring vessel. The resulting mixture was then wet-ground in a SZEGO mill (mean particle size approx. 17 microns) and, after addition of 3.0 kg silicone foam inhibitor, was degassed to a residual gas content of 2.0% by volume by applying a vacuum of 20 mbar in a stirring vessel equipped with an anchor stirrer and Teflon strippers.

8.0 kg granulated and encapsulated alkalase, 250.0 kg sodium perborate tetrahydrate (mean particle size approx. 1500 microns, pore size 10 to 40 microns, as measured by mercury porosimetry) and 30.0 kg soap based on $C_{16-22}$ fatty acids were weighed into an evacuable vessel and degassed. The contents of the vessel were then stirred in vacuo (20 mbar) into an evacuable mixing vessel. Finally, 3.0 kg optical brightener, 0.5 kg dye, and 3.0 kg perfume were added. A detergent having a viscosity of 132,000 mPas was obtained. The pH-value of a 1% solution of this detergent in water at 20° C. was 10.5.

Portions of 75 g of this detergent were packed in bags of a 65 microns thick polyvinyl alcohol film soluble in a borate-containing aqueous solution. The bags were sealed by heat sealing. A test bag was placed in the drum of an automatic domestic washing machine, the drum subsequently loaded with 3.5 kg fabrics, and the dissolving rate of the bag tested using the coloreds. program (30° C., one-liquor method), it was found that the bag and the detergent had completely dissolved after a washing time of 10 mins.

Example 2

A phosphate-free detergent having the following composition was prepared similarly to Example 1:

125 kg alkylbenzene sulfonate
28 kg $C_{12-18}$ fatty alcohol+5 moles ethylene oxide
112 kg $C_{12-14}$ fatty alcohol+3 moles ethylene oxide
66 kg polyethylene glycol (molecular weight 300)
160 kg zeolite NaA
90 kg sodium carbonate
50 kg powdered soda waterglass, $SiO_2$:$Na_2O$ ratio=2.0, (residual water content approx. 20% by weight),
50 kg polymeric polycarboxylate (Sokolan® CP5)
5 kg methyl cellulose/carboxymethyl cellulose, (3:7 mixture),
2 kg silicone foam inhibitor
270 kg sodium perborate tetrahydrate granulate
8 kg granulated, encapsulated alkalase
3 kg optical brightener
30 kg $C_{16-22}$ soap
1 kg perfume This detergent had a viscosity of 38,000 mPas. Its dissolving behavior was as described in Example 1. The detergents of Examples 1 and 2 were excellent in their detergent action against fatty/pigment soil, enzymatic soil and also against bleachable soil both in hard and in soft water. With very hard water, up to 3 bags were used; with soft water, only 1 bag was used.

What is claimed:

1. A process for producing a detergent having a liquid surfactant component comprising
(a) a non-ionic surfactant selected from the group consisting of adducts of a $C_{10}$–$C_{20}$-fatty alcohol with from 2 to 8 moles ethylene oxide per mole fatty alcohol;
(b) an anionic surfactant selected from the group consisting of surface active soaps, sulfates, sulfonates, and mixtures thereof; and
(c) polyethylene glycol having a molecular weight of from about 200 to 600; and a particulate solids component comprising
(d) a first finely divided fraction having an average particle size of from about 0.01 to 30 microns; and
(e) a second more coarsely divided fraction having an average particle size of from about 200 to 2000 microns;

wherein the particulate solids component includes at least one member selected from the group consisting of a builder, a redeposition inhibitor, an optical brightener, a detergency-promoting enzyme, a bleach, a bleach activator, and a foam inhibitor; said process comprising
(f) admixing the liquid components of the detergent including the liquid surfactant component with the solid components of the detergent which do not substantially chemically interact with each other or with the liquid components to form a suspension;
(g) wet grinding the suspension to reduce the particle size of the solid components to an average particle size of 30 microns or less to provide a ground suspension;
(h) admixing the ground suspension with the second coarsely divided solids fraction; and
(i) degassing the mixture.

2. The process of claim 1, further including the steps of degassing the ground suspension, degassing the coarsely divided solids fraction before admixing with the ground suspension, or both.

3. The process of claim 1, wherein the mean particle size of the solid components in the ground suspension is less than the mean pore size of the solid components in the coarsely divided solids fraction.

4. The process of claim 1, wherein the detergent contains less than about 5% by weight unbound water.

5. The process of claim 1, wherein the detergent contains less than about 5% by volume of gaseous components which are gaseous at room temperature.

6. The process of claim 1, wherein the detergent contains less than about 3% by volume gaseous components.

7. The process of claim 1, wherein the detergent has a final viscosity of from about 10,000 to 1,000,000 mPas.

8. The process of claim 1, wherein the second coarsely divided fraction comprises a granulated solid.

9. The process of claim 1, wherein the non-ionic and anionic surfactants are present in a ratio of from about 1.1:1 to 1.5:1 and the polyethylene glycol is present in an amount of from about 2 to 10% by weight based on the total weight of detergent.

10. The process of claim 1, wherein the total liquid surfactant component comprises from about 25 to 40% by weight of the detergent.

11. The process of claim 1, wherein the adduct contains from 3 to 5 moles ethylene oxide per mole fatty acid.

12. The process of claim 1, wherein the fatty alcohol is a $C_{12}$–$C_{18}$-fatty alcohol.

13. The process of claim 1, wherein the non-ionic surfactant comprises a mixture of adducts of fatty alcohols having different numbers of carbon atoms.

14. The process of claim 1, wherein the anionic surfactant comprises a sulfonate and a soap.

15. The process of claim 1, wherein the soap also functions as a foam inhibitor.

16. The process of claim 1, wherein the soap is an alkali metal salt of a $C_{18}$–$C_{24}$-fatty acid.

17. The process of claim 1, wherein the polyethylene glycol component (c) has a molecular weight of from about 300 to 400.

* * * * *